US007175452B1

(12) United States Patent
Lin et al.

(10) Patent No.: US 7,175,452 B1
(45) Date of Patent: Feb. 13, 2007

(54) MEMORY CARD CONNECTOR

(75) Inventors: Yi-Sheng Lin, Banqiao (TW); Yen-Lin Chen, Banqiao (TW); Shiou-Chi Shiu, Banqiao (TW)

(73) Assignee: ITW Tech. Co., Ltd., Taipei County (TW)

( * ) Notice: Subject to any disclaimer, the term of this patent is extended or adjusted under 35 U.S.C. 154(b) by 0 days.

(21) Appl. No.: 11/233,044

(22) Filed: Sep. 23, 2005

(51) Int. Cl.
*H01R 13/62* (2006.01)

(52) U.S. Cl. ..... 439/159; 439/607

(58) Field of Classification Search ..... 439/152, 439/155, 159, 160, 607, 630
See application file for complete search history.

(56) References Cited

U.S. PATENT DOCUMENTS 6,592,385 B1 * 7/2003 Chen ..... 439/159
6,746,256 B1 * 6/2004 Wang ..... 439/159
6,955,548 B1 * 10/2005 Wang et al. ..... 439/159
6,976,880 B1 * 12/2005 Chi-te et al. ..... 439/630
2002/0037658 A1 * 3/2002 Ozawa ..... 439/159
2003/0013334 A1 * 1/2003 Kuroda ..... 439/159
2003/0139077 A1 * 7/2003 Sasaki et al. ..... 439/159
2005/0186817 A1 * 8/2005 Yang et al. ..... 439/159

* cited by examiner

*Primary Examiner*—Hien Vu
(74) *Attorney, Agent, or Firm*—Troxell Law Office, PLLC

(57) ABSTRACT

A memory card connector includes an insulative frame, a plurality of conductive terminals, an ejecting mechanism for guiding a memory card in or out, and a conductor connecting with a circuit system. The ejecting mechanism includes a guiding groove, a guiding device displacing in the guiding groove, and an urging element providing returning force for the guiding device. The conductor is located in a position before an ejection portion of the guiding groove for detecting the memory card as which is disconnected from a circuit system at the earliest time that the ejecting mechanism be ejected from a starting position of the ejection portion, thereby the circuit system has sufficient time to protect the proceeded data before the memory card disengages wholly from the terminals during the memory card ejects out, avoiding the proceeded data being lost and preventing the memory card from being damaged.

15 Claims, 8 Drawing Sheets

MEMORY CARD CONNECTOR

BACKGROUND OF THE INVENTION

1. Field of the Invention

The present invention relates to a memory card connector, and particularly to a Push—Push Type memory card connector which quickly detects that a memory card is about to be drawn out, and correspondingly, prompts the system to protect processed data and avoids the memory card's damage.

2. Related Art

Memory cards are popularly used in a variety of applications, like digital cameral, mobile phone, and Personal Digital Assistant. Card connectors are adapted to connect the memory cards and electronic products. The card connectors commonly have ejectors for allowing the memory cards being inserted in or ejected out. An ejector of a conventional Push—Push Type memory card connector has a guiding bar 70 sliding/positioning in a heart-like groove 71. Referring to FIG. 1A, a memory card is inserted into a card connector and the guiding bar 70 moves along a heart-like groove 71 of the card connector. FIG. 1B show displacement-time diagrams of the memory card during the memory card insertion and ejection from the memory card connector. The fully insertion period of the memory card being inserted into the heart-like groove 71 is designated as 731. A gold finger (not labeled) of the memory card contacts a terminal of the card connector at a starting position, which is designated as 732. The gold finger of the memory card disengages from the terminal of the card connector at a departing position, which is designated as 737. During insertion, the memory card arrives at a final position designated as 733. The fully ejecting period of the memory card ejecting from the card connector is designated as 734. During ejection, the memory card ejects from a starting position designated as 734', and to a final position designated as 734". The fully working period is designated as 736. Data buffer period is designated as 735 (shown in FIG. 2). A detecting position of the memory card is designated as 72. A detecting buffer time from the detecting position 72 through the departing position 737, where the gold finger of the memory card disengages from the terminal of the card connector, is designated as 74.

The Push—Push Type card connector has the following shortcomings.

The proceeded data tend to be lost. Referring to FIG. 2, the detecting buffer time 74, which is from the detecting position 72 to the departing position 737 where the gold finger of the memory card disengages from the terminal of the card connector is short because the detecting position 72 located at the latter position of the data buffer period 735. Thus the proceeded data can't be saved timely before the memory card is fully ejected out. So the proceeding data may be lost once mis-touching to the memory card occurs. To avoid data being lost, user directions of these products ordinarily note that, the memory card is prohibited to be drawn out while the data is read or written.

Moreover, the memory card may be damaged. Mis-touching to the memory card may also damage the memory card, even making the memory card unable to be re-used.

SUMMARY OF THE INVENTION

Accordingly, an object of the present invention is to provide a Push—Push Type memory card connector detecting the memory card's ejecting at the earliest time that the memory card be ejected from a starting position of ejecting, ensuring the proceeded data are protected effectively before a gold finger of a memory card disengages from a terminal of the card connector, and avoiding the memory card being damaged.

The memory card connector comprises an insulative frame, a plurality of conductive terminals, an ejecting mechanism for guiding a memory card in or out, and a conductor. The ejecting mechanism includes a guiding groove, a guiding device and an urging element. The guiding groove has an insertion portion for guiding the memory card insertion, a positioning portion for positioning the memory card, and an ejection portion for guiding the memory card ejection. The guiding device cooperates with the memory card insertion/ejection, and displaces along the insertion portion, the position portion and the ejection portion of the guiding groove. The urging element provides returning force for the guiding device. The conductor is located in a position before the ejection portion of the guiding groove for detecting the memory card as which is disconnected from a circuit system at the earliest time that the ejecting mechanism be ejected from a starting position, thereby the circuit system has sufficient time to protect the proceeded data before the memory card disengages wholly from the terminals during the memory card ejects out.

In some embodiments of the present invention, the conductor is conductive spring sheet, spring wire or power wire, and has a first end in the position before the ejection portion of the guiding groove, and a second end contacting the circuit system.

DESCRIPTION OF THE PREFERRED EMBODIMENTS

Figures 1A, 1B:
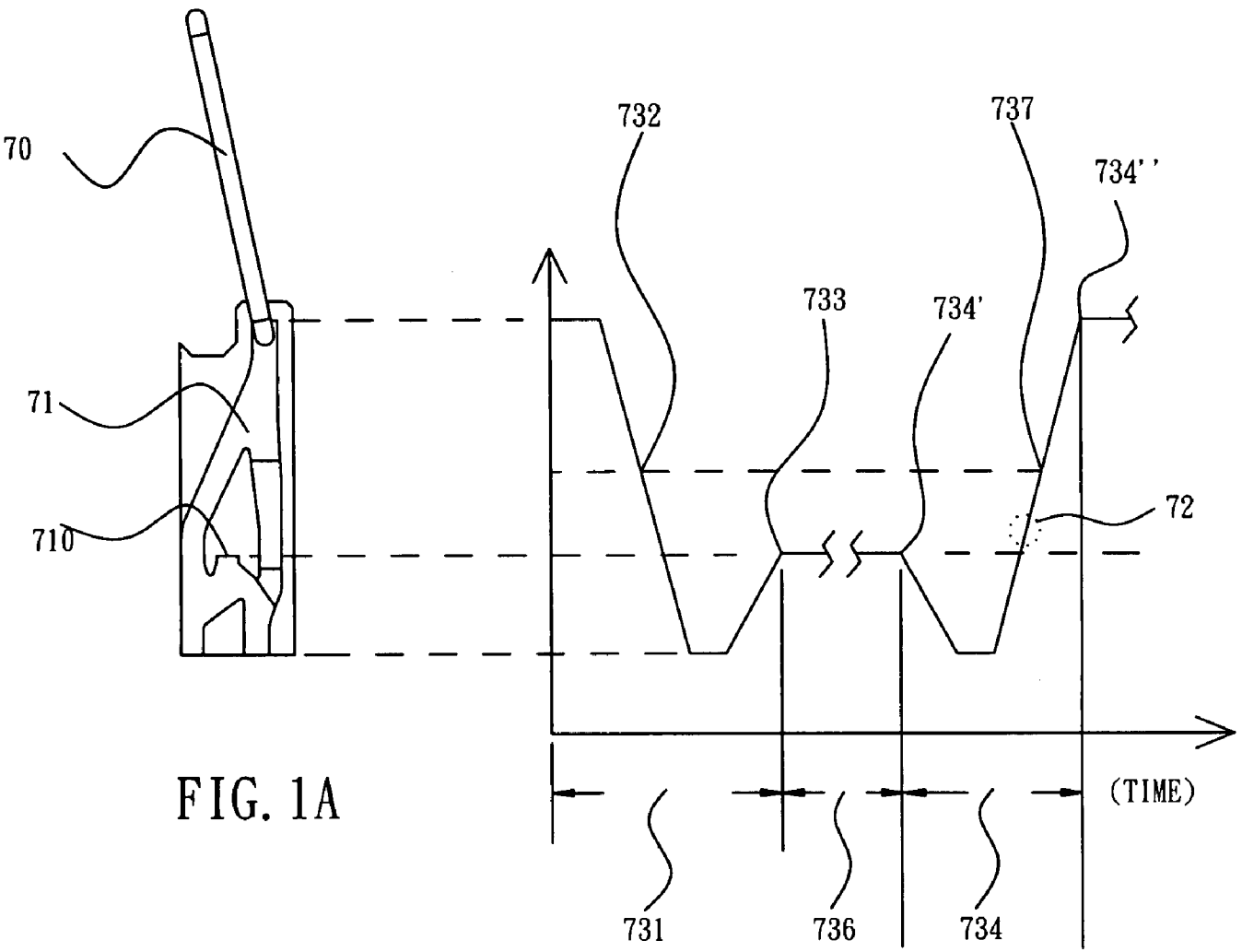
FIGS. 1A, 1B and 2 are displacement-time diagrams of a guiding bar moving in a hear-like groove of a conventional Push—Push Type card connector.
Figure 2:
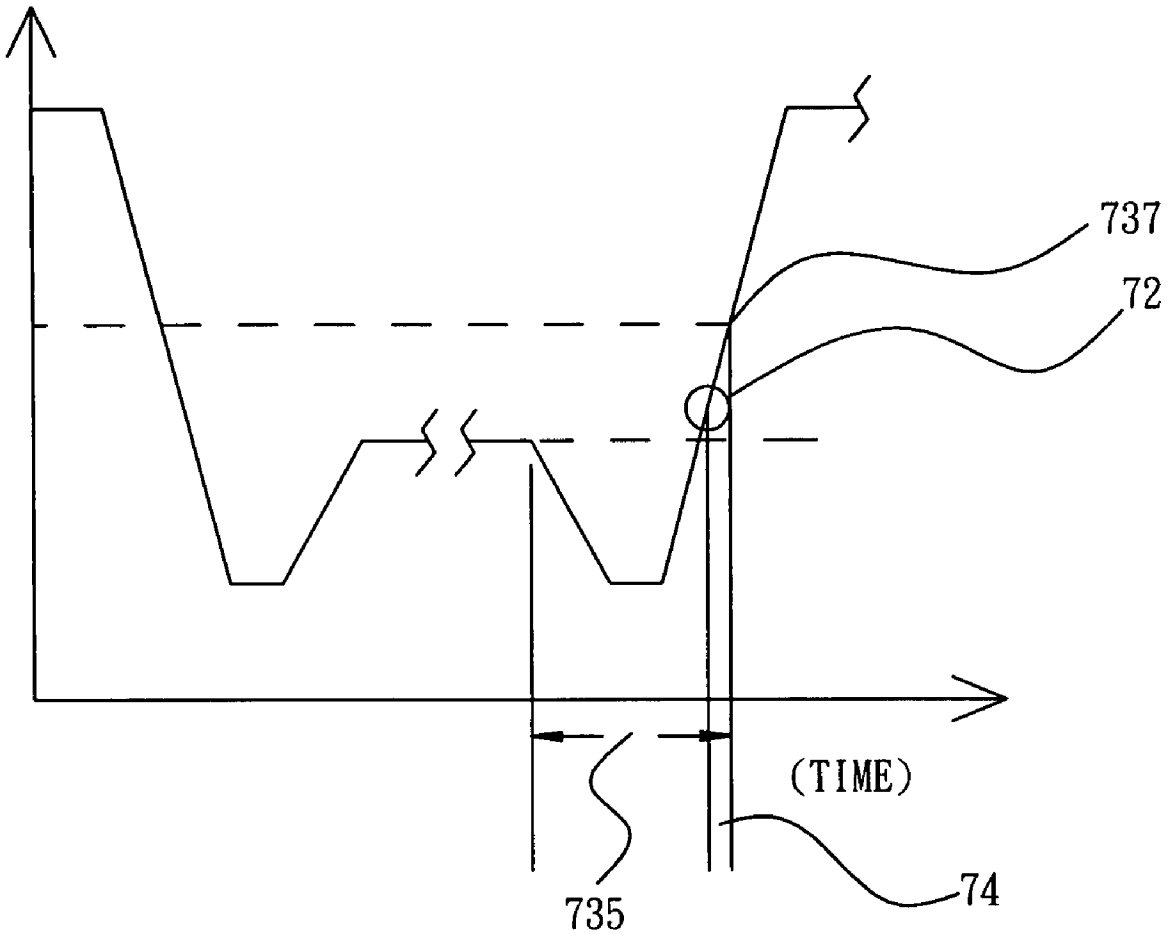
Figure 3:
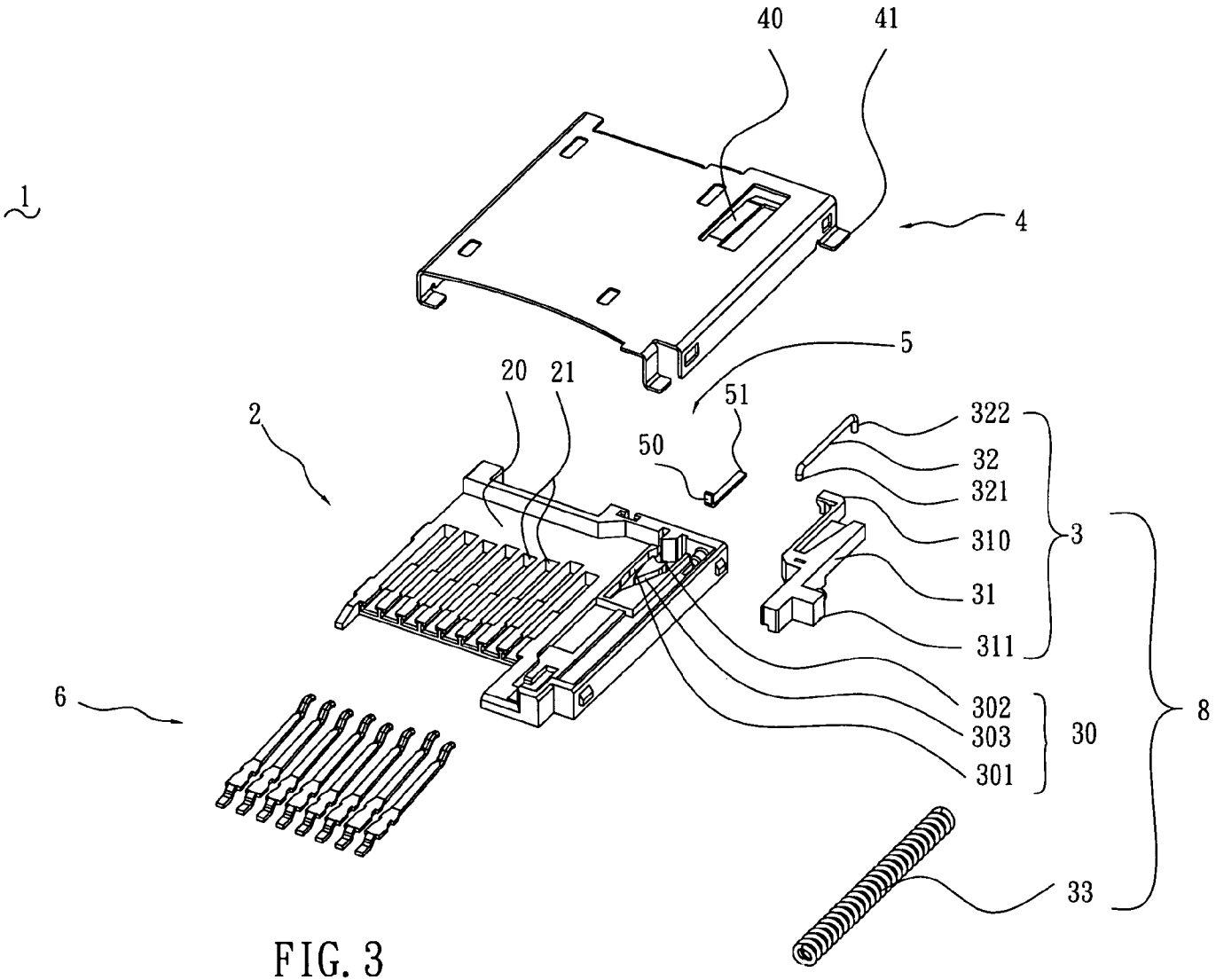
FIG. 3 is an exploded view of a memory card connector of a first embodiment of the present invention.

With reference to FIG. 3, a memory card connector 1 of the present invention comprises an insulative frame 2, a plurality of conductive terminals 6, an ejecting mechanism 8, a shell 4 and a conductor 5. The insulative frame 2 (partly shown) has an insertion space 20 into which a memory card is loaded, a plurality of passageways 21 being defined in the insulative frame 2 for receiving the conductive terminals 6.

The ejecting mechanism 8 is assembled at a side of the insulative frame 2 including a guiding groove 30, a guiding device 3 and an urging element 33. The guiding groove 30 is defined in the insulative frame 2 with heart-like shape, and includes an insertion portion 301 for guiding the memory card insertion, a positioning portion 302 for positioning the memory card, and an ejection portion 303 for guiding the memory card ejection. The guiding device 3 includes a sliding pole 31 and a guiding bar 32. The sliding pole 31 is assembled in the assembling groove 22, and has a link portion 310 at an end thereof for bearing the memory card, and a biasing portion 311 at an opposite end thereof for biasing against an end of the urging element 33. The guiding bar 32 has a pivoting end 321 pivoted on the sliding pole 31, and a sliding end 322 moving in the guiding groove 30. The urging element 33 is a compressed spring for providing return force for the guiding bar 32.

The shell 4 is made of metal and is mounted on a side of the insulative frame 2 for enveloping the housing 20. A stop 40 is formed adjacent a side of the shell 4 and corresponding to the ejecting mechanism 8 for abutting against the guiding bar 32. A solder 41 extends from an edge of the shell 4 for surface mounting on a circuit system (not shown).

The conductor 5 is a conductive spring sheet, and includes a first contact portion 50 and a second contact portion 51. The first contact portion 50 is received in the positioning portion 302 of the guiding groove 30, and will be off from the pivoting end 321 of the guiding bar 32 when the ejecting mechanism 8 is ejecting from the starting position, which will be interpreted below. The second contact portion 51 is bent to surface mount on the circuit system.

Figure 5:
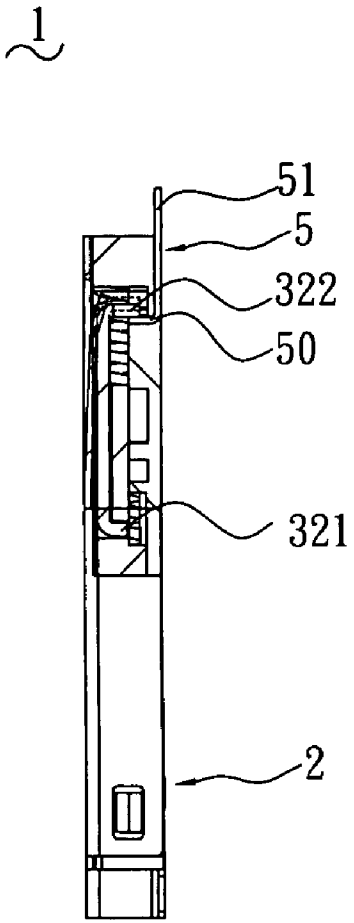
FIG. 5 is a sectional view taken along the line 5—5 of FIG. 4.
Figure 4:
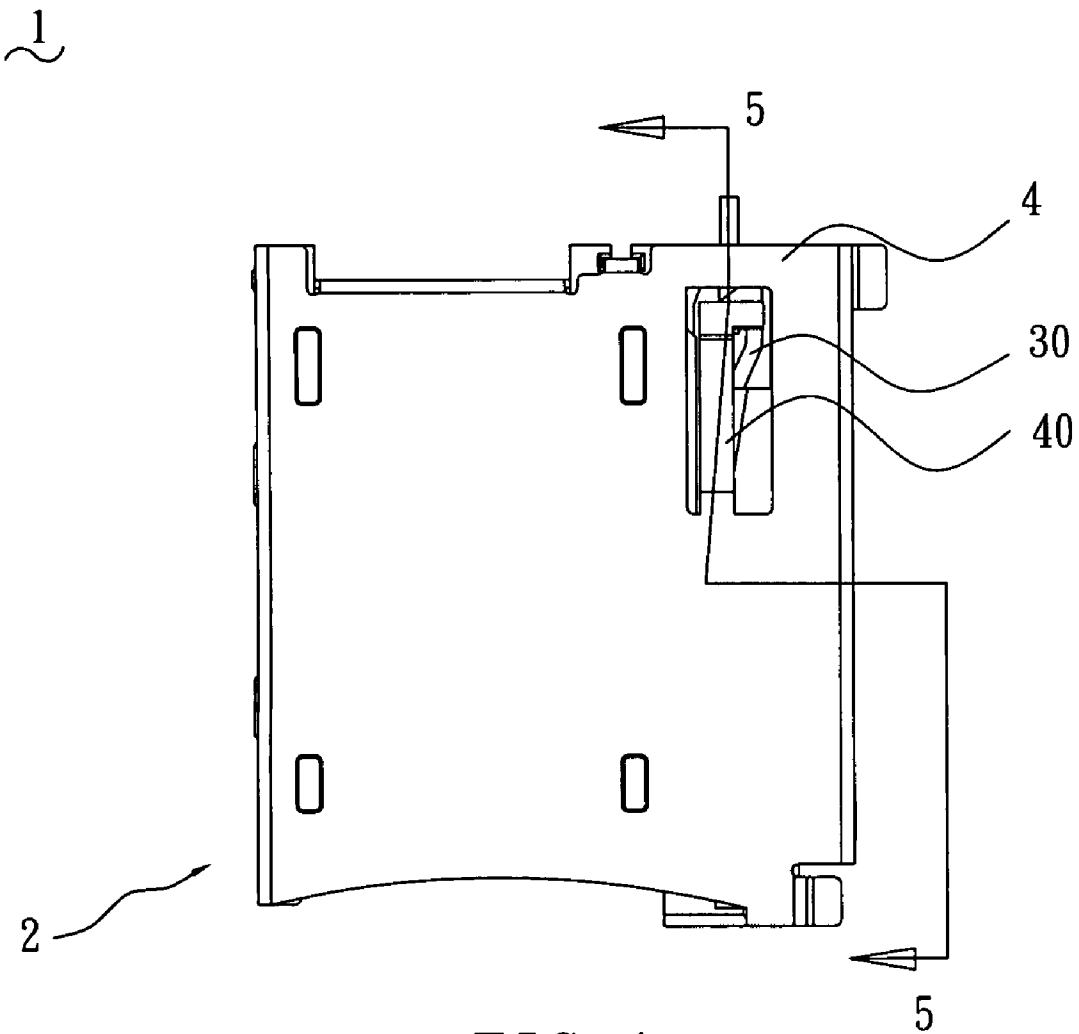
FIG. 4 is an assembled and top view of the memory card connector of FIG. 3.
Figures 6A, 6B:
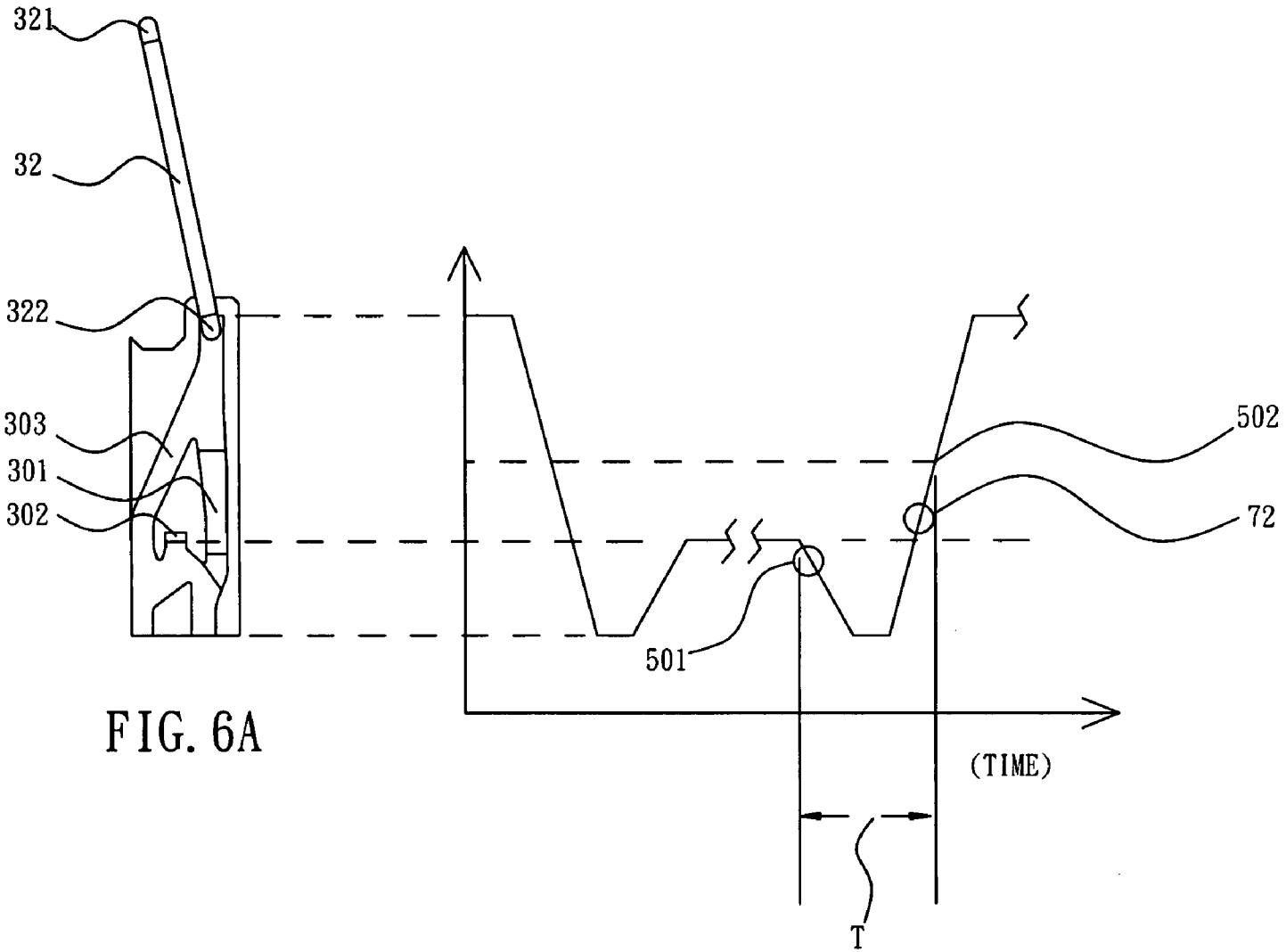
FIGS. 6A, 6B and 7 are displacement-time diagrams of a guiding bar moving in a hear-like guiding groove of the memory card connector of FIG. 3.
Figure 7:
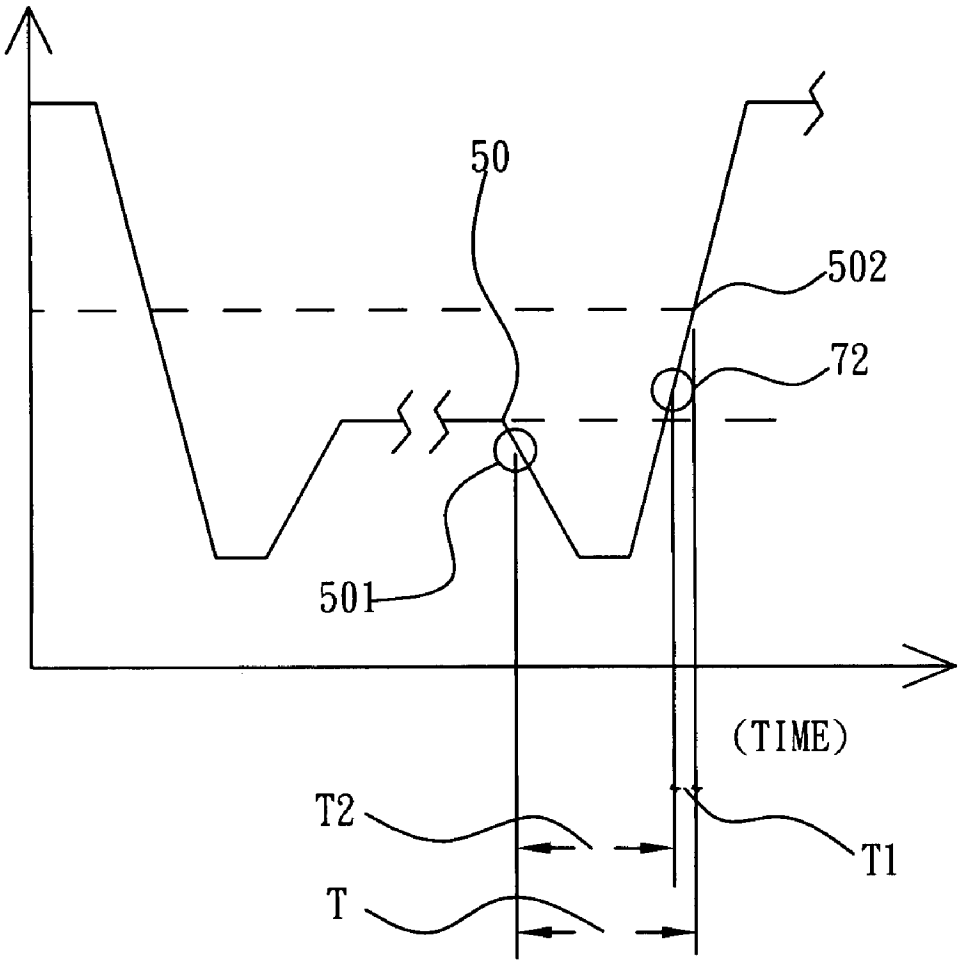

Referring to FIGS. 4 and 5, when the ejecting mechanism 8 is activated to start to work, the sliding end 322 of the guiding bar 32 starts to deviate from the first contact portion 50 of the conductor 5 (Shown in FIG. 5 with broken line), and detected the memory card will be ejected out by user. Refering FIGS. 6A, 6B and 7 are displacement-time diagrams of the guiding bar 32 moving in a hear-like guiding groove 30 of the memory card connector 1 of FIG. 3, referring to FIGS. 6A and 6B, the sliding end 322 of the guiding bar 32 starts to deviate from the first contact portion 50 of the conductor 5, which is designated as the earliest time 501. The time that the terminals 6 start to depart from a gold finger (not shown) of the memory card is designated as a final time 502. Referring to FIG. 7, the period from the earliest time 501 through the final time 502 is designated as T. The period from a detecting position 72 to the final time 502 is designated as T1. The period T minus the period T1 is T2. The conductor 5 detects the memory card as which is disconnected from a circuit system at the earliest time 501 that the ejecting mechanism be ejected from a starting position, thus the circuit system has sufficient time T2 to protect the proceeded data before the gold finger disengages wholly from the terminals 6 during the memory card ejects out, avoiding the proceeded data being lost and preventing the memory card from being damaged.

Figure 8:
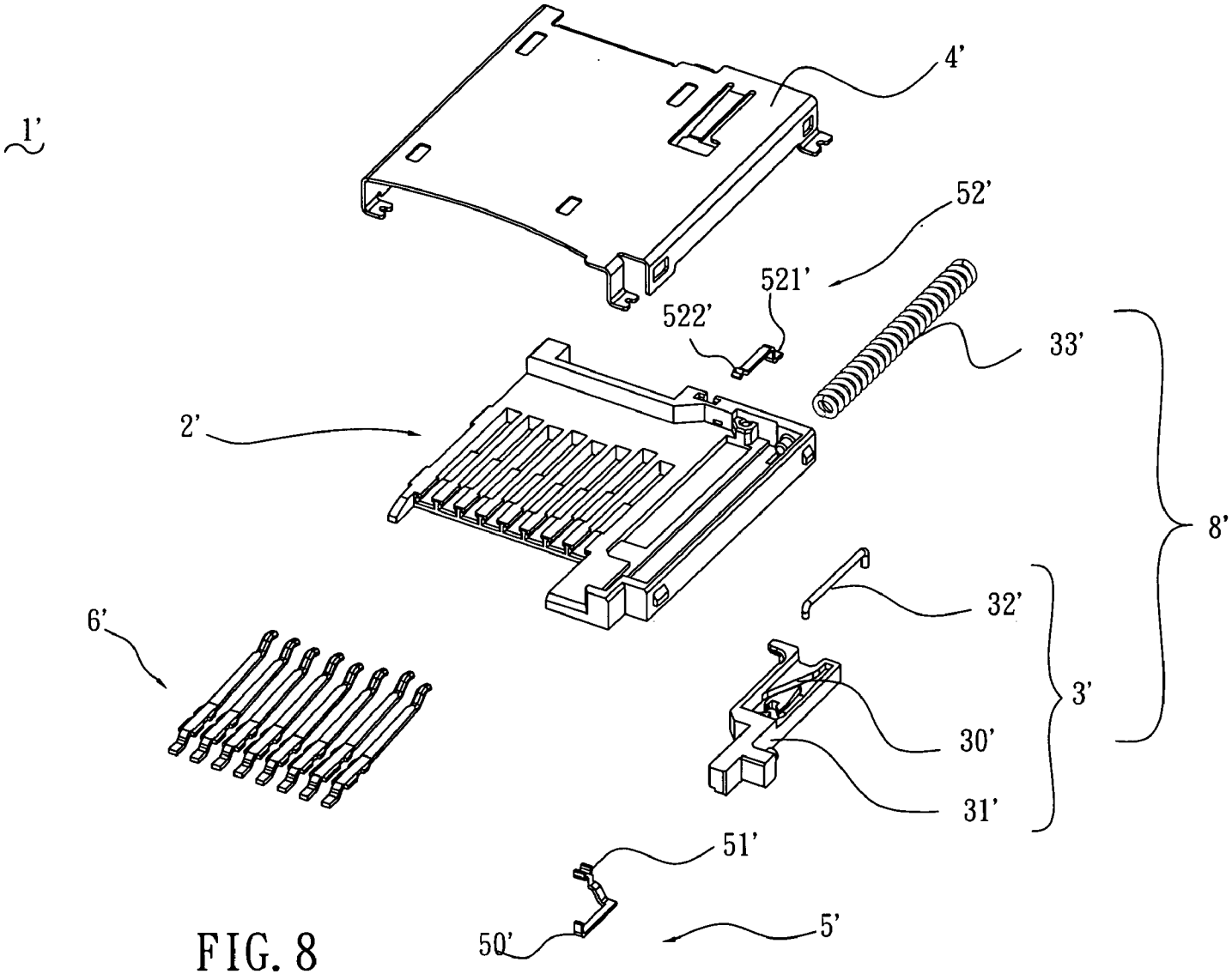
FIG. 8 is an exploded view of the memory card connector of a second embodiment of the present invention.
Figure 10:
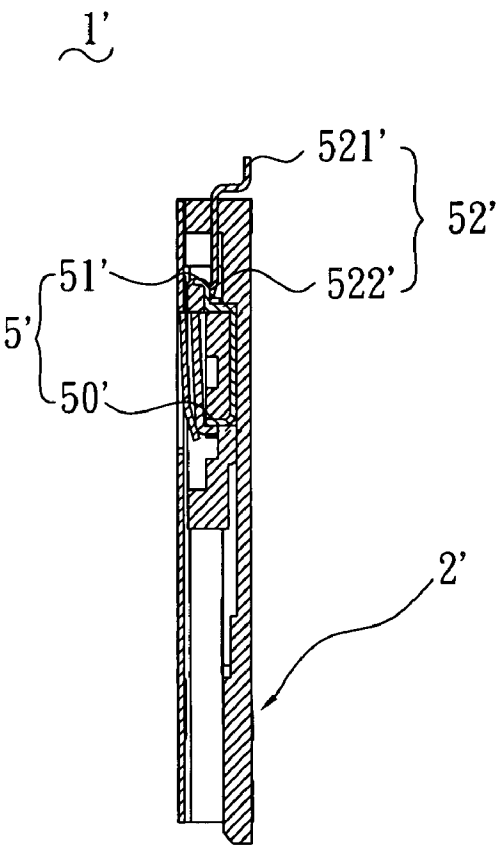
FIG. 10 is a sectional view taken along the line 10—10 of FIG. 9.
Figure 9:
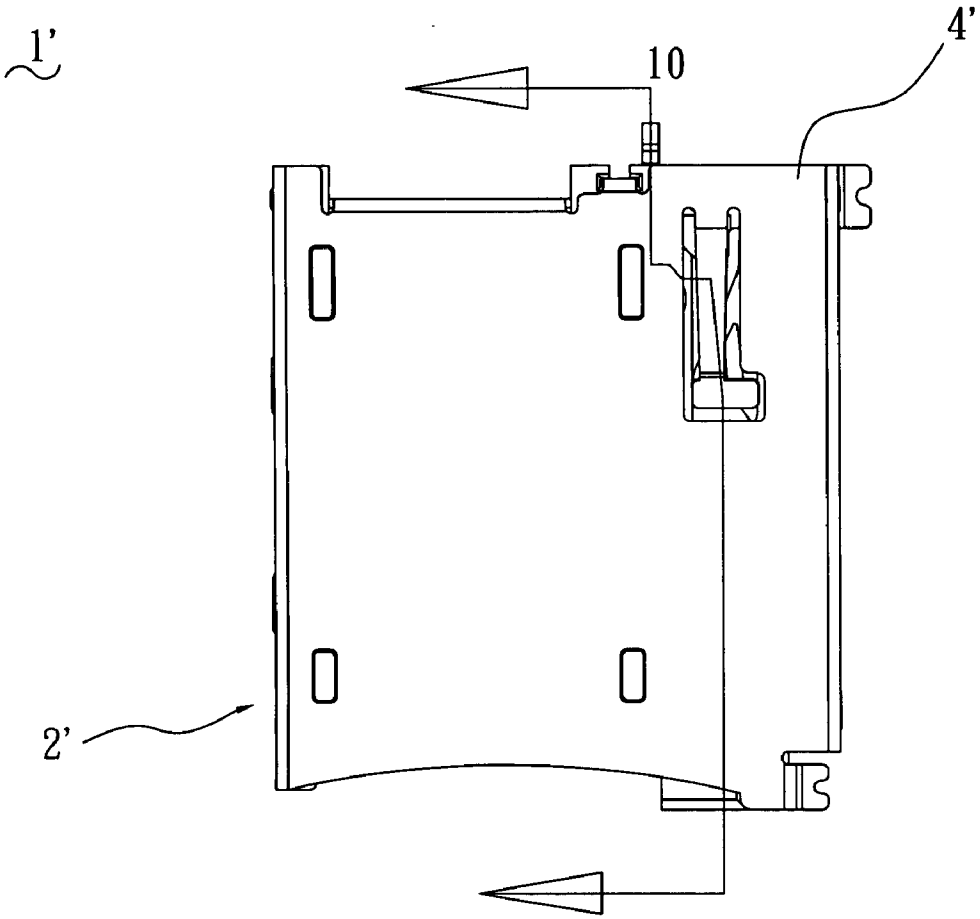
FIG. 9 is an assembled and top view of the memory card connector of FIG. 8.

FIGS. 8–10 show a second embodiment of the present invention. The memory card connector 1' of the second embodiment is similar to the memory card connector 1 of the first embodiment, and comprises an insulative frame 2', an ejecting mechanism 8', a shell 4', a conductor 5' and conductive terminals 6'. The ejecting mechanism 8' has a guiding groove 30' defined in a sliding pole 31'. The memory card connector 1' further comprises a conductive sheet 52' for contacting the conductor 5'. A second contact portion 51' of the conductor 5' contacts the conductive sheet 52' before a first contact portion 50' of the conductor 5' enters an ejection portion of the guiding groove 30'. The conductive sheet 52' has a first end 521' being bent to surface mount on a circuit system (not shown), and a second end 522' contacting the second contact portion 51'. Similarly, the detecting position is located in a position before the ejection portion of the guiding groove for detecting the memory card disconnected from a circuit system, and therefore the circuit system have sufficient time to protect the proceeded data before the gold finger disengages wholly from the terminals 6' during the memory card ejects out, avoiding the proceeded data being lost and preventing the memory card from being damaged.

In other embodiments of the present invention, the conductor may be replaced with spring wire or power wire, and has a first end in a position before the ejection portion of the guiding groove, and a second end contacting the circuit system. Thus the detecting position is also located in a position before the ejection portion of the guiding groove for detecting the memory card disconnected from a circuit system.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A memory card connector, adapted to connect with a circuit system, comprising:

an insulative frame having an insertion space into which a memory card is loaded;

a plurality of conductive terminals for transmitting data between the memory card and the circuit system;

an ejecting mechanism mounted on the insulative frame, and including:

a guiding groove having an insertion portion for guiding the memory card insertion, a positioning portion for positioning the memory card, and an ejection portion for guiding the memory card ejection;

a guiding device cooperating with the memory card insertion/ejection, and displacing along the insertion portion, the position portion and the ejection portion of the guiding groove, the guiding device including a guiding bar; and an urging element for resiliently urging the guiding device in the ejection direction of the memory card; and a conductor having a first contact portion located in the positioning portion of the guiding groove and a second contact portion contacting the circuit system, the first contact portion selectively engaging the guiding bar, the firsts contact portion separating from the guiding bar at a time when the ejecting mechanism is ejected from a starting position in the ejecting portion, wherein the guiding device includes a sliding pole, the sliding Dole having a link portion at an end thereof for bearing the memory card.

2. The memory card connector as claimed in claim 1, wherein a biasing portion at an opposite end of the sliding pole, the guiding bar having a pivoting end pivotally connected to the sliding pole, and a sliding end moving in the guiding groove.

3. The memory card connector as claimed in claim 2, wherein the guiding groove is defined in the insulative frame.

4. The memory card connector as claimed in claim 3, wherein the guiding groove is heart-like.

5. The memory card connector as claimed in claim 4, wherein the urging element is a spring.

6. The memory card connector as claimed in claim 4, wherein the urging element is a compressed spring.

7. The memory card connector as claimed in claim 6, further comprising a shell mounted on a side of the insulative frame for enveloping the insulative frame.

8. The memory card connector as claimed in claim 7, wherein a stop is formed on the shell and corresponding to the ejecting mechanism for abutting against the guiding bar.

9. The memory card connector as claimed in claim 1, wherein the first contact portion being located in a position before the ejection portion of the guiding groove.

10. The memory card connector as claimed in claim 1, wherein a biasing portion at an opposite end of the sliding pole, the guiding bar having a pivoting end pivotally connected to the insulative frame, and a sliding end moving in the guiding groove.

11. The memory card connector as claimed in claim 10, wherein the guiding groove is heart-like.

12. The memory card connector as claimed in claim 11, wherein the urging element is a spring.

13. The memory card connector as claimed in claim 12, wherein the urging element is a compressed spring.

14. The memory card connector as claimed in claim 13, further comprising a shell mounted on a side of the insulative frame for enveloping a housing of the insulative frame.

15. The memory card connector as claimed in claim 14, wherein a stop is formed on the shell and corresponding to the ejecting mechanism for abutting against the guiding bar.

* * * * *